US005389269A

United States Patent [19]

Kleber et al.

[11] Patent Number: 5,389,269

[45] Date of Patent: Feb. 14, 1995

[54] BIODEGRADABLE SPIN FINISHES

[75] Inventors: Rolf Kleber, Neu-Isenburg; Frank Weinelt, Burgkirchen; Lothar Jaeckel, Flörsheim am Main; Adelgunde Oberhauser, Neuötting, all of Germany

[73] Assignee: Hoechst Aktiengesellschaft, Frankfurt am Main, Germany

[21] Appl. No.: 181,359

[22] Filed: Jan. 13, 1994

Related U.S. Application Data

[62] Division of Ser. No. 959,997, Oct. 13, 1992, abandoned.

[30] Foreign Application Priority Data

Oct. 15, 1991 [DE] Germany ..... 4134113

[51] Int. Cl.[6] ..... D06M 13/137

[52] U.S. Cl. ..... 252/8.6; 252/8.9

[58] Field of Search ..... 252/8.6, 8.9

[56] References Cited

U.S. PATENT DOCUMENTS

| | | | |
|---|---|---|---|
| 2,010,900 | 8/1935 | Schneider | 91/68 |
| 2,068,003 | 1/1937 | Blake et al. | 28/1 |
| 2,249,519 | 7/1941 | Dickey et al. | 28/1 |
| 3,926,816 | 12/1975 | Cohen et al. . | |
| 4,113,645 | 9/1978 | De Simone | 252/187 H |
| 4,314,000 | 2/1982 | Thir et al. | 428/265 |
| 4,520,176 | 5/1985 | Martin et al. | 524/598 |
| 5,266,221 | 11/1993 | Klebber et al. | 252/8.9 |

FOREIGN PATENT DOCUMENTS

| | | |
|---|---|---|
| 2540873 | 3/1977 | Germany . |
| 3936975 | 1/1991 | Germany . |
| 2017100 | 10/1979 | United Kingdom . |

*Primary Examiner*—Paul Lieberman
*Assistant Examiner*—Michael P. Tierney
*Attorney, Agent, or Firm*—Connolly & Hutz

[57] ABSTRACT

The invention relates to spin finishes comprising compounds of the formula

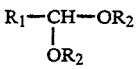

1 in which $R_1$ is a straight-chain or branched alkyl radical of the empirical formula $C_nH_{2n+1}$ or a straight-chain or branched alkenyl radical of the empirical formula $C_nH_{2n-1}$ where n is in each case 1 to 9 and $R_2$ is a straight-chain or branched alkyl radical of the empirical formula $C_nH_{2n+1}$ where n is 2 to 16, and also to their use as spooling oils for synthetic fibers.

4 Claims, No Drawings

BIODEGRADABLE SPIN FINISHES

This application is a division, of application Ser. No. 07,959,997, filed on Oct. 13, 1992, now abandoned.

DESCRIPTION

Spin finishes are applied to textile fibers, filament or staple, during production and further processing, in order to reduce fiber or filament breakages upon exposure to mechanical stress. Spin finishes also facilitate the processes during production, such as winding, drawing, crimping, texturing, weaving, carding and knitting.

In recent years, additional demands have been made on spin finishes to the effect that these agents should be readily biodegradable in the waste water. The objective of these demands is to eliminate by biodegradation the spin finishes entering the waste water of textile plants during dyeing or pretreatment. The term "biodegradable" is understood to mean that the components of spin finishes, such as lubricants, surfactants, yarn cohesifiers or else antistats, are biodegraded as completely as possible or at least to the extent of 70% by weight, for example by the enzymes or bacteria present in the sludge of a water treatment plant. It is desirable that this degradation produces chemically simple compounds, such as carbon dioxide, water, sulfate or phosphate. The extent of biodegradability can be determined, for example, by means of the metabolites formed or the degree of biological elimination. In the technical literature, various biodegradability tests are mentioned, such as the river water test (OECD 301 C test), the Zahn-Wellens test (OECD 302 B test) or else the Sturm test.

The lubricant/surfactant mixtures usually used as spin finishes specifically for filaments are increasingly readily biodegradable as regards the surfactants, but the previous non-surfactant lubricants based on mineral oils, such as white oils, or synthetic esters, such as pentaerythritol tetrapelaronate are hardly or not at all biodegradable. The readily biodegradable surfactants include fatty alcohol ethoxylates. U.S. Pat. No. 3,926,816 describes specifically spooling oils based on nonbiodegradable lubricants of the alkyl fatty acid ester type with a $C_{10}$–$C_{18}$-fatty alcohol and a $C_6$–$C_{22}$-fatty acid. Other lubricants which are also non-biodegradable are inert water-insoluble mineral oils of low viscosity.

It is still very difficult to provide biodegradable spin finishes. This is what the invention seeks to remedy.

The invention provides spin finish comprising a compound of the formula

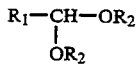

1 in which $R_1$ is a straight-chain or branched alkyl radical of the empirical formula $C_nH_{2n+1}$ or a straight-chain or branched alkenyl radical of the empirical formula $C_nH_{2n-1}$ where n is in each case 1 to 9 and $R_2$ is a straight-chain or branched alkyl radical of the empirical formula $C_nH_{2n+1}$ where n is 2 to 16.

The acetals of the formula 1 can be easily prepared from the corresponding alcohols and aldehydes by acid catalysis. First, the alcohol and the aldehyde are dissolved in a solvent which simultaneously serves as the entrainer for the water formed in the reaction. The boiling range of the solvent is below 100° C., preferably between 30° and 90° C. Suitable solvents are aliphatic hydrocarbons, such as n-hexane, hydrocarbon mixtures, such as petroleum ether or halogenated hydrocarbons, such as dichloromethane or chloroform. In order to obtain high yields of acetals, the alcohol is added in excess. The aidehyde/alcohol ratio is in the range from 1:1.1 to 1:6, preferably 1:4. The catalysts used are the acid catalysts customary for the preparation of acetals, such as sulfuric acid or p-toluenesulfonic acid. The solution is then refluxed until no more water of reaction separates. After reaction is complete, the solution is brought to a pH in the range from about 7–9 with a 2–5% by weight sodium alcoholate solution, preferably sodium methoxide solution. The entrainer and the unconsumed alcohol are removed from the alkaline solution by subsequent distillation. The acetal remains as a liquid, in most cases oily, residue and is separated off from the solid sodium alcoholate formed, for example by filtration. If necessary, the acetal can be purified by distillation.

These acetals exhibit a number of advantageous properties, allowing wide applicability in the area of fiber production and further processing of fibers. Thus, it has been found that these acetals have good biodegradability despite their branching in the acetal CHO group and their often low water solubility. The water solubility is in the range from 10 to 100% by weight. The degree of biodegradability of the spin finishes can be determined in the case of the acetal by the OECD 302 B test. This test has shown that the degree of biodegradability is in the range of up to 100% by weight of the compounds of the formula 1 used.

Moreover, it has been found that the acetals of the formula 1 have pronounced lubricating properties and can be used as spooling oils, without lowering the rub fastness of dyed fibers, in particular polyester fibers dyed with a disperse dye. The spooling oils can have various compositions. Thus, the spooling oils can comprise only the acetal compounds (neat oil application) or can be applied to the fiber with the addition of 1–20% by weight of a surfactant for improving the removability of the spooling oils by washing. The surfactants used are the surfactants customarily used for spooling oil but with a requirement of exhibiting the property of biodegradability.

Apart from their use as spooling oils, the acetals according to the invention can be used as spin finishes either by themselves or in a mixture with one another or with other spin finish components known per se, such as surfactants, antistats of the $P_2O_5$ ester salt type, yarn cohesifiers and others.

When a mixture of the compounds of the formula 1 with known spin finish components is used, the relative amount of the compounds of the formula 1 should be at least 10 parts by weight, preferably more than 30 parts by weight, and particularly preferably more than 70 parts by weight. The relative amount of biodegradable surfactants in the spin finish is in the range from 90 to 10 parts by weight.

When synthetic fibers are processed using the compounds of the formula 1 or mixtures thereof with other spin finish componants, the total add-on is about 0.1 to 4% by weight, preferably about 1 to 2% by weight, relative to the weight of the fiber. Application to the fiber takes place by customary methods, for example by dipping, spraying, dip-padding or face-padding, during spinning, drawing or as final preparation by means of godets. The spin finishes can be applied, as is customary, from water as a solution or dispersion, if appropriate with the use of suitable solvents or dispersants, such as petroleum ether.

The filaments and fibers used can be continuous filaments, staple fibers, tows or stuffing fibers. Examples of suitable synthetic fibers to be used for the spin finishes according to the invention are fibers made of polyesters, polyamides, polyacrylonitrile, polyolefins, such as polyethylene or polypropylene, or copolymers based on the abovementioned compounds. Preferably, the compounds of the formula 1 are used for the processing of polyester fibers.

The invention will be illustrated below by means of examples.

General procedure for preparing the acetals I to VIII mentioned in the examples below:

3.5 mol of aidehyde, 14 mol of alcohol, 500 g of n-hexane, methylene chloride or chloroformare mixed, 1 g of p-toluenesulfonic acid is added as a catalyst, and the mixture is heated to boiling. The water formed is distilled off azeotropically. After water formation is complete, the mixture is made alkaline with sodium methoxide solution, and the entrainer and the unconsumed alcohol are then distilled off. The acetal is filtered off from the precipitated salt and can optionally be distilled.

The physical data of acetals I to VIII are listed in Table A.

TABLE A

Physical data of Examples I to VIII

| | Name | m.p. | $n_D^{21}$ | Viscosity mPa.s, 15° C. |
|---|---|---|---|---|
| I | Butyraldehyde di-n-butyl acetal | 196° C. | 1.4160 | 1.9 |
| II | Acetaldehyde di-2-ethyl-hexyl acetal | 269° C. | 1.4350 | 5.19 |
| III | Acetaldehyde di-n-hexyl acetal | 246° C. | 1.4235 | 2.76 |
| IV | Isobutyraldehyde di-n-hexyl acetal | 251° C. | 1.4270 | 3.8 |
| V | n-Butyraldehyde di-n-octyl acetal | 224° C. | 1.4370 | 7.6 |
| VI | Isobutyraldehyde di-n-octyl acetal | 230° C. | 1.4351 | 7.7 |
| VII | Isobutyraldehyde dibutyl-glycol acetal | 272° C. | 1.4285 | 4.5 |
| VIII | Isobutyraldehyde di-2-ethylhexyl acetal | 228° C. | 1.4352 | 7.8 |

Biodegradability test of spin finishes IX to XVI:

The biodegradability test of spin finishes IX to XVI is carried out using the OECD 302 B test. Spin finishes IX to XVI each comprise 90 parts by weight of one of the acetals I to VIII and 10 parts by weight of coconut fatty alcohol (5 EO). (EO denotes ethylene oxide units)

For comparison with spin finishes IX to XVI according to the invention, spin finishes XVII and XVIII are also tested for their biodegradability.

NAME

XVII Mineral oil/coconut fatty alcohol (5 EO) 90 parts by weight/10 parts by weight XVIII Butyl stearate/isotridecyl alcohol (7 EO) 95 parts by weight/5 parts by weight Table B shows the extent of biodegradability.

TABLE B

| Spin finishes | Biodegradability |
|---|---|
| IX-XVI | >80% |
| XVII | <30% |
| XVIII | <25% |

Rub fastness test and wash-off test:

Knit hose made of textured polyester (dtex 1676 f 32), which has been dyed blue with a disperse dye, is treated with the spin finishes listed below.

NAME

IX Butyraldehyde di-n-butyl acetal/coconut fatty alcohol (5 EO) 90 parts by weight/10 parts by weight XVII Mineral oil/coconut fatty alcohol (5 EO) 90 parts by weight/10 parts by weight XVIII Butyl stearate/isotridecyl alcohol (7 EO) 95 parts by weight/5 parts by weight The spin finishes are applied by means of godets, giving an add-on of 3% by weight, relative to the weight of the knit hose.

Rub fastness test:

The knit hoses thus processed are tested unfixed or after fixing for their rub fastnesses according to DIN 54021 at a temperature of 180° C. over a period of 30 seconds and, after 14 days of storage, at a temperature of 20° C. and an atmospheric humidity of 60%, using a crockmeter. The rub fastness test is carried out using dry knit hose and hose wetted with electrolyte-free water.

The rub fastness is evaluated using reference standards intended for this purpose, the standards being given a rating from 1 (poor rub fastness) to 6 (very good).

Wash-off test:

To test the removability by washing, the abovementioned unfixed and fixed knit hoses are washed with 3 g/l of an aqueous sodium lauryl sulfate solution at a liquor ratio of 10:1 and a temperature of 60° C. over a period of 30 minutes, and the wash-off is evaluated under UV light. The wash-off is evaluated analogously to the evaluation of rub fastness and the results are likewise listed in Table C.

TABLE C

| | Rub fastnesses Unfixed | | Rub fastnesses Fixed | | Wash-off |
|---|---|---|---|---|---|
| Name | Dry | Wet | Dry | Wet | Fixed |
| IX | 6 | 6 | 5 | 5 | 6 |
| XVII | 4 | 4 | 3 | 3 | 4 |
| XVIII | 3 | 2 | 2 | 2 | 3 |

What is claimed is:

1. A method of spin finishing textile fibers, filament, or staple, which comprises, applying as the spin finish, compounds of the formula

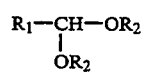

I in which $R_1$ is a straight-chain or branched alkyl radical of the empirical formula $C_nH_{2n+1}$ or a straight chain or branched alkenyl radical of the empirical formula $C_nH_{2n-1}$ where n is in each case 1 to 9, and $R_2$ is a straight-chain or branched alkyl radical of the empirical formula $C_nH_{2n+1}$ where n is 2 to 9.

2. The method as claimed in claim 1, wherein the spin finish contains compounds of the formula I in which $R_1$ and $R_2$ are identical and are a straight-chain or branched alkyl radical.

3. The method as claimed in claim 1, wherein the spin finish contains 10 to 90 parts by weight of the compounds of the formula 1 and, 90 to 10 parts by weight of biodegradable surfactants.

4. The method as claimed in claim 1, wherein the biodegradability of the spin finish is at least 70% by weight, relative to the spin finish, determined by the OECD 302 B test.

* * * * *